United States Patent [19]

McGlew et al.

[11] 4,395,967

[45] Aug. 2, 1983

[54] LIFE BOAT SUPPORT STRUCTURE

[76] Inventors: John J. McGlew; John J. McGlew, Jr., both of Box 823 (E. Lake Rd.), Tuxedo Park, N.Y. 10987

[21] Appl. No.: 268,160

[22] Filed: May 29, 1981

[51] Int. Cl.[3] ..... B63B 23/10

[52] U.S. Cl. ..... 114/373; 403/81; 248/160; 52/115; 414/4

[58] Field of Search ..... 114/365–373; 403/15, 31, 81; 414/548, 4; 248/159, 160, 122; 182/2; 52/115–117; 212/190, 192, 266–268

[56] References Cited

U.S. PATENT DOCUMENTS

| | | | |
|---|---|---|---|
| 1,455,159 | 5/1923 | Wright | 114/373 |
| 1,746,109 | 2/1930 | Edwards | 114/370 |
| 2,385,841 | 10/1945 | Pampinella | 114/373 |
| 2,473,557 | 6/1949 | Woodruff | 114/373 |
| 3,092,856 | 6/1963 | Wallace et al. | 114/373 |
| 4,139,110 | 2/1979 | Roberts | 114/373 |
| 4,271,553 | 6/1981 | Korsvik | 114/373 |

FOREIGN PATENT DOCUMENTS

| | | | |
|---|---|---|---|
| 677909 | 8/1979 | U.S.S.R. | 414/4 |

*Primary Examiner*—Trygve M. Blix
*Assistant Examiner*—Thomas J. Brahan
*Attorney, Agent, or Firm*—McGlew and Tuttle

[57] ABSTRACT

A support structure for devices particularly life boats and similar apparatus which is weight operated comprises a plurality of support members, each or some of which may be telescopic which are pivotally interconnected adjacent their associated interconnected ends. Each successive upper one of a pair of such members is pivotal relative to the next adjacent lowermost one about a substantially horizontal axis. The pivoting is controlled by a control mechanism which is operated from a fluid pressure source produced by the weight of the elements upon each other. The control mechanism includes means for controlling the amount of tilt of each upper element relative to an adjacent lower element and for the control of the precise angularity of the two elements relative to each other during the pivotal movement. The construction is such that a life boat may be supported in either a lower or an elevated position on a large ship and the individual support members may be articulated relative to each other so as to pivot the boat outwardly away from the vessel or ship in any manner which is desired. Thus if the ship is on an even keel some of the support members may be held without pivoting and merely one or two of them pivoted to lower the boat to a position in which it contacts the water line. In those cases in which it is desired that the boat be swung outwardly a large amount away from the vessel before it is pivoted downwardly then only the lowermost two elements are pivoted relative to each other, for example. The feature of the construction is that the weight of the life boat itself will cause operation of the controls for the pivoting and for the control of the positioning of each element relative to each other during the proper lowering of the boat into the water.

16 Claims, 13 Drawing Figures

FIG. 3
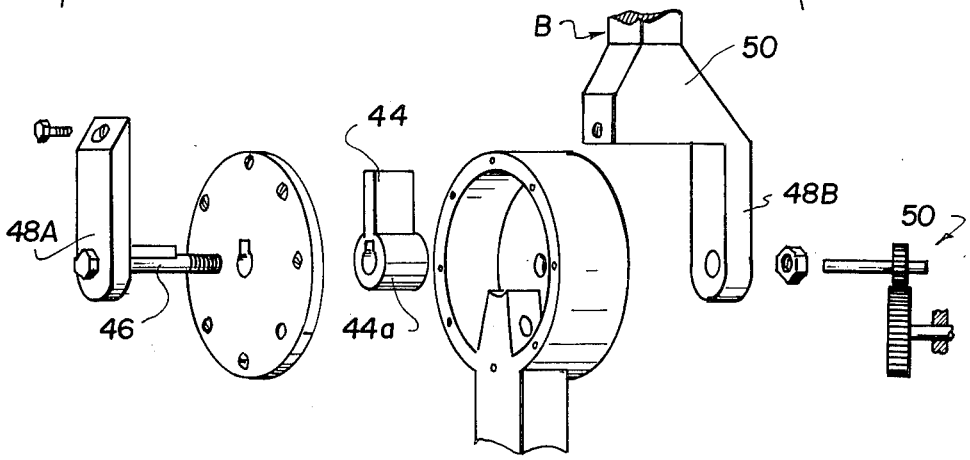
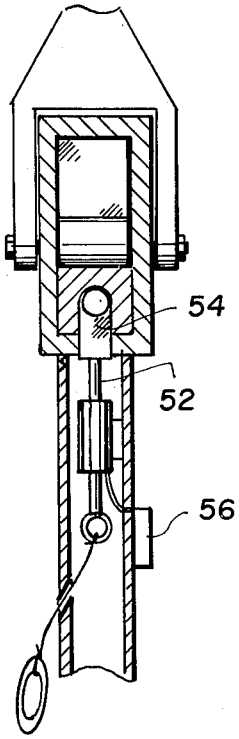
FIG. 4
FIG. 5
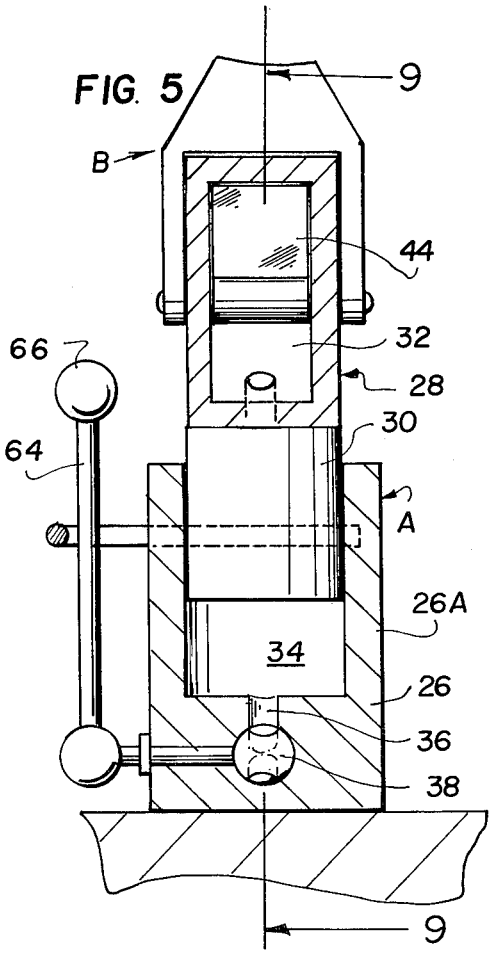

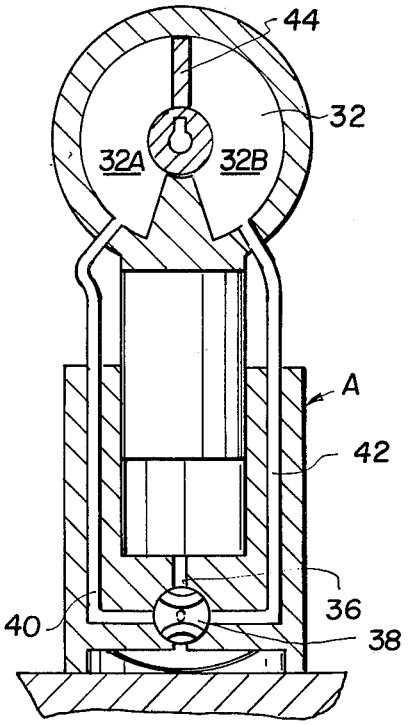
FIG. 9
FIG. 10
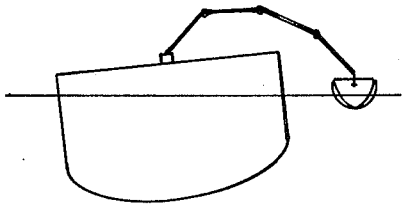
FIG. 11
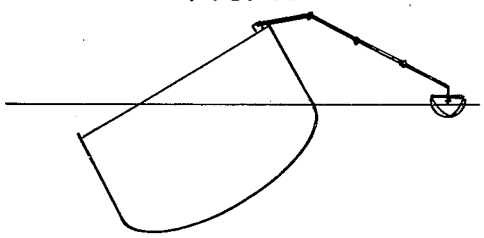
FIG. 12
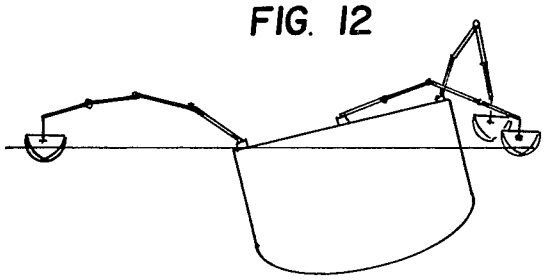
FIG. 13
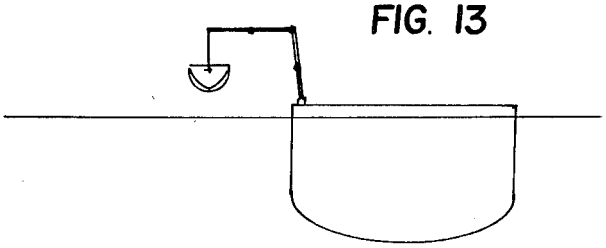

LIFE BOAT SUPPORT STRUCTURE

FIELD AND BACKGROUND OF THE INVENTION

This invention relates in general to the construction of support devices for supporting elements at an elevation so that they may be lowered downwardly to a lower elevation and particularly, a support structure for life boats which is operable independently of any source of power.

There have been many instances in which life boats could not be launched from vessels because the davit mechanism for lowering the boat could not operate to present the boat outwardly away from a tilted side of the ship or far enough away from a ship which is in the stage of sinking, or at a precise location away from a ship which is the stage of sinking or at a precise location away from any falling debris or fire or wreckage. Known mechanisms which can be lowered by the power of the weight of the life boat itself in some instances are still such that they operate only to lower the life boat downwardly directly alongside a side of the larger vessel carrying the boat. This means that in many instances in which the large ship in sinking, there are either obstacles in the path of lowering the boat or there is a danger that the lines will become fouled due to the large tilt of the ship or become endangered by some other reason due to the fact that the boat cannot be precisely positioned in water relative to the larger ship.

SUMMARY OF THE INVENTION

In accordance with the invention there is provided a life boat structure which is made up of a plurality of support elements or members which are pivotally interconnected adjacent their associated interconnected ends so that adjacent upper and lower pairs of the elements may be pivoted relative to each other about a substantially horizontal axis. A control mechanism is provided which is powered by the weight of the elements which support the life boat or by the weight of the life boat itself for initiating a pivot of the elements relative to each other in one direction of rotation or the other and for controlling the amount of pivots so that the elements will accurately position a boat either close to the side or far away from the associated ship.

In accordance with a feature of the invention, the support elements advantageously include a lowermost support element with a control mechanism which is operated by the weight of the next uppermost element in an associated cylindrical portion of the lowermost element to generate a fluid pressure which is used to control the rotation or pivot of the next uppermost element relative to the lowermost element. Thus for example, in some instances it may be desirable to pivot the boat in one direction toward the outside of the ship when the ship is oriented in a particular manner in the sea, but it may be more advantageous to pivot it in another direction on some other occasions. The control mechanism makes it possible to control the initial pivot of each of the plurality of these elements so that the eventual lowering of the boat into the water will be at a precise location from the location of the support members. For this purpose the invention envisions the use of a chart or scale on each boat davit showing which element should be pivoted and the degree of angular pivot of each one in order to achieve a launching of the life boat at a desirable location. This information may be stored on the life boat support in the form of a chart indicating what pivots of each individual support elements are necessary to achieve the desired life boat launching, and could include information for example, as to distance that the life boat would be launched outwardly from the associated lowermost support member and from the side of the vessel. This information could be programmed into a control element which will permit the desired rotation of each of the support members located above the lowermost member.

In order that each of the pairs of support members which are articulated together are provided with a control both for initiating the initial direction of rotation and a further control for controlling the total amount of rotation that the upper one will make relative to the lower one, each successive pair of support elements is provided with such a rotational control and fluid pressure operated connection thereto for effecting such control. Alternatively each element may have its own separate control which may be remotely operated. In the preferred arrangement all of the elements may be locked in a vertical or upstanding position by means of a suitable pin which may be removed whenever the life boat is to be employed and lowered. Such a control may be actuated, for example, whenever any additional weight is placed in a life boat as for example when some of the personnel on the vessel enter into it.

In one form of execution each upper member is articulated to a next lowermost member on a shaft containing an impeller which is held in position by fluid pressure so that it and the associated member is held at a proper angle relative to the next adjacent lower member. Upon the manipulation of a control such as a hand lever the pressure in the portion of the lower member which defines a pressure chamber may be switched so that pivoting will be effected in a desired direction of rotation and also to a desired angle of rotation. A similar mechanism may be arranged on each pair of elements or the controls may be a single control for all of the elements located in one central station, for example, adjacent the lowermost element.

Accordingly, it is an object of the invention to provide a support structure particularly for life boats, which comprise a plurality of support members which are pivotally interconnected adjacent their associated interconnected ends so that each adjacent upper and lower members of the pair are pivotal relative to each other and to the next adjacent lower or upper member about a horizontal axis, and control means are connected between the adjacent members for controlling the rotational direction and amount of rotation in each upper one of said members relative to the next adjacent lower one.

A further object of the invention is to provide a support structure for life boats which permits the lowering of a life boat outwardly and downwardly at any desired angle and spacing from the associated ship and using the weight of the life boat to effect the controlled movement in an manner such that the life boat may be accurately positioned alongside the ship.

A further object of the invention is to provide a life boat support structure which may position a life boat either close to a ship's deck or at an elevated position in respect thereto which is made of a plurality of support elements which may be separately rotatably pivoted to one side of the other of a ship for the purpose of positioning a life boat in a water alongside the ship either directly adjacent the ship or at a selected space location outwardly therefrom.

A further object of the invention is to provide a method of launching a lifeboat which is supported on the uppermost one of a plurality of support members which include a lowermost support member which is pivotally mounted on a deck of a ship and a plurality of other support members extending upwardly from the lowermost one and being pivotally connected together, comprising applying a force to pivot selected ones of the support members relative to the others while blocking the pivotal connections between the others so as to maintain a rigid interconnection of the others, and using this force to control the amount of lowering of the boat which is thereby effected by the pivotal movement of the selected ones and which also controls the amount of outward movement of the boat relative to the associated lowermost support member.

A further object of the invention is to provide a method of launching a lifeboat in which a pressure force is generated by the weight of the lifeboat or the associated support members in a fluid pressure chamber which is advantageously provided between adjacent ones of the support members, and wherein this force is thereafter applied to pivot selected ones of the support members and also to maintain other ones in a rigid interconnection and wherein fluid pressure control is used to either pivot or extend the arms outwardly relative to each other so as to control both the amount of descent and outward swing of the lifeboat.

A further object of the invention is to provide a support structure particularly for life boats which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is an exploded view of a pivot and angular positional control mechanism constructed in accordance with the invention;

FIG. 4 is a section taken along the line 4—4 of FIG. 1;

FIG. 5 is a section taken along the line 5—5 of FIG. 1;

FIG. 9 is a section taken along the line 9—9 of FIG. 5; and

FIGS. 10, 11, 12 and 13 are schematic sectional views indicating the manner of launching the life boat from the support structures constructed in accordance with the invention.

DESCRIPTION OF THE PREFERRED EMBODIMENTS

Figure 1:
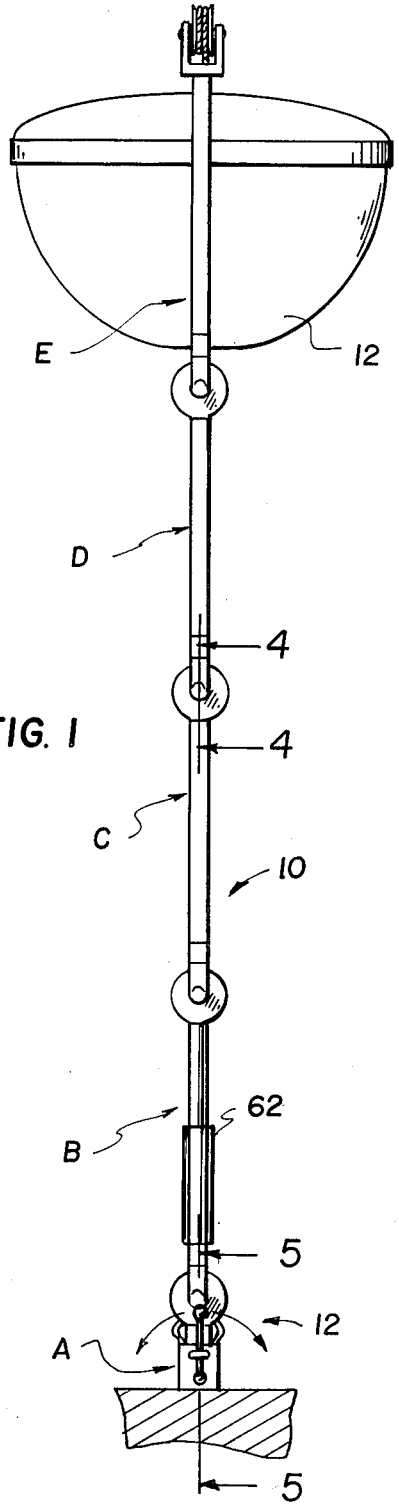
FIG. 1 is a end elevational view partly in section of a ship having a life davit support structure constructed in accordance with the invention.

Referring to the drawings in particular, the invention embodied therein comprises a support structure generally designated 10 particularly for the support of a life boat 12 and which comprises a plurality of support members A, B, C, D, E. In the embodiments shown the uppermost one of the support members E is provided with a lug 14 having a pulley 16 over which a line 18 may be engaged having a suitable block and tackle (not shown) which is connected to a line 20 secured to a connection 22 of the life boat 12. The block and tackle which is not shown may be provided for lowering the boat from the uppermost support element E after it is positioned in a desired orientation with the water or a suitable quick release may be provided for the life boat at the location of its upper end instead of the lug 14 if so desired.

In accordance with the invention each of the support members A, B, C, D, E is provided with a lower end which may be either articulated to the next adjacent member or in the case of the support member A might be anchored or articulated to a deck or similar ship structure 24. In the embodiment illustrated the lowermost support member A comprises a tubular member 26 which in anchored to the deck 24. The member A includes another rod-like portion 28 having a piston part 30 which rides in a cylinder part 26*a* of the first part 26. Part 28 also includes an upper end defining a pressure chamber 32.

In accordance with the invention it is desirable to control both the direction of pivotal rotation of a next higher member such as the member B in respect to the adjacent next lower member A. For this purpose a fluid pressure source which is provided by fluid pressure in a cylinder space 34 is used to determine which way the member B will pivot in respect to the member A and thus determine whether life boat 12 will be shifted in either a clockwise direction or a counter clockwise direction. The pressure in the cylinder space 34 is produced by the weight of the member B on the member A and the piston portion 30 of the member B causes a fluid under pressure to flow from the cylinder space 34 to a conduit 36 having a control valve 38 for controlling both the direction of pivot and the angular position of member B relative to member A therein which as shown in FIGS. 5 and 9 may be adjusted to permit flow through either one of the conduits 40 or 42 which communicate with respective sides of a piston or vane member 44 which rides in the pressure space 32. The vane member 44 divides the pressure space 32 into separate pressure chambers 32*a* and 32*b* and the pressure in these chambers determines the position of the vane member 44. The valve 38 may also provide for the leading of pressure from the lines 40 or 42 to the opposite area. Vane member 44 has a hub portion 44*a* which is secured on a shaft 46 for rotation therewith. Shaft 46 is connected through arm portions 48*a* and 48*b* of a bifurcated end 48B of the member generally designated B. Thus since the vane member 44 is secured to the member B, rotation of the vane member reflects a similar rotation of the member B and its accurate tilting position. A feature of the construction is that the member B may be initially tilted relative to its next lowest member by an amount which may be accurately controlled by the positioning of the vane member 44 which in turn may be controlled by varying the pressure in respect to chambers 32*a* and 32*b* to aid in the initial rotational movement in a selected direction and then the holding of the members at the relative angle in respect to each other at a predetermined end position. In some instances it is also preferable to drive the shaft 46 through a gearing mechanism generally designated 50 so as to affect the control positioning of the vane member 44 and hence of the arm member 50 relative to the member A or to hold it in a selected angular position once it has moved to an end position. Thus the relative position of each of the links A-B; B-C; C-D; D-E relative to each other may be accurately controlled in respect to angular position relative to each other as well as direction of rotation relative to each other. In addition, the shifting of one member relative to the other may occur up to a certain predetermined limit which may be easily set by the drive mechanism or by the fluid pressure or by some other stopping means to stop the rotation of one support member relative to the other.

In the upright position of the support 10 the members A, B, C, D, E may be held upright for example, by a locking pin 52 which may be engaged in a holding recess 54 when the davit is in a fixed position and prior to any life boat usage. These pins may be pulled out either electrically by an electrical control switch 56 so as to immediately actuate all the members to initially permit them to be shifted or pivoted, each one in respect to the next adjacent one, for the purpose of launching a life boat.

Figure 6:
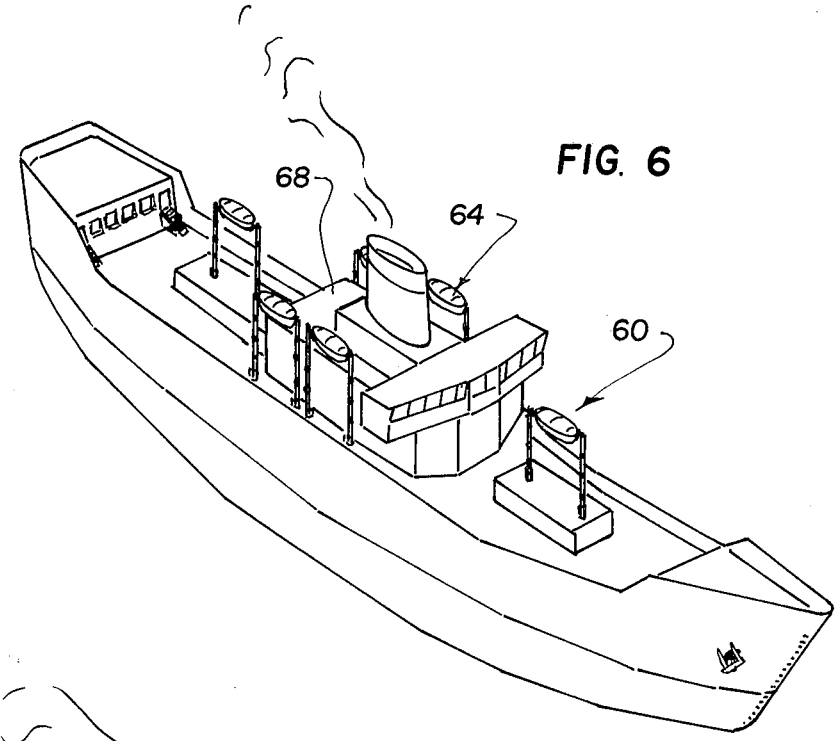
FIG. 6 is a forward top perspective view of a vessel having a life davit system constructed in accordance with the invention.

It should be appreciated that only the lowermost two members A and B have been indicated as containing the mechanism which provides means for initially pivotally rotating one of the members relative to the other in an initial rotational direction and also provide means for setting the member at a desired angle in an end position for the purpose of lowering a life boat; but each one of the pairs of members may have such a control mechanism therebetween so that the support structure may be shifted from the upright or stowage position or seagoing position as shown by the vessel in FIG. 6 or, to one of the launching positions for example as shown in FIGS. 7, 8 and 10 to 13.

Figure 7:
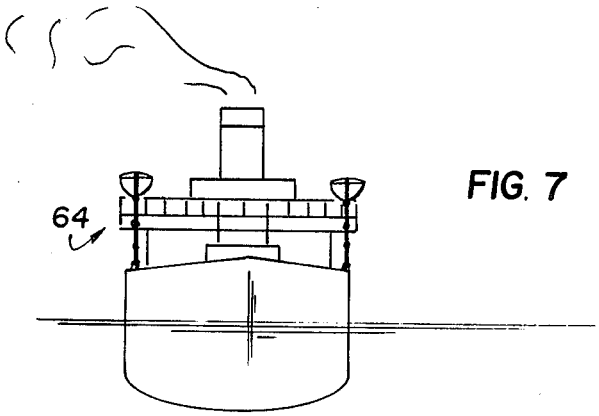
FIG. 7 is a front elevational view of the vessel shown in FIG. 6.
Figure 8:
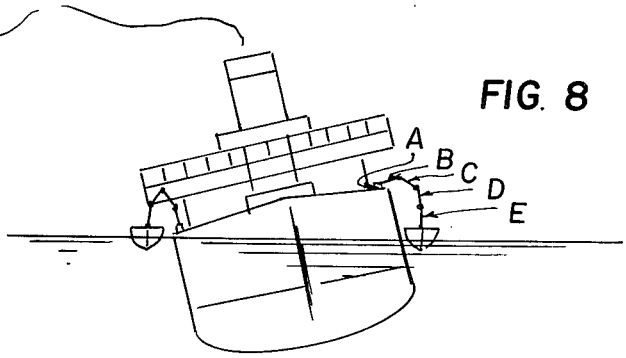
FIG. 8 is a view of the vessel shown in FIG. 6 with a starboard list.

In FIGS. 6, 7 and 8 the life boats are shown as being held on support structures 10 at each end and at an elevation which in many instances is high above the associated deck. In respect to the life boat support structure generally designated 60 shown near the bow of the vessel in FIG. 6, it should be appreciated that each of the support elements advantageously are made up of one or more telescopic members which for example, may include a central cylinder 62 as shown with the element B to which the end elements may be retracted. In addition the lowermost element A may be mounted so that a portion is in a receiving cylinder which may be retracted well into the deck. In some cases, however, it may be expedient to allow the boat such as the mounting 60 to remain at an elevated level and to provide a superstructure which may permit the passengers to gain access to the boat by climbing a ladder or some other structure located alongside of it. The life boat structure assemblies 64 shown toward the mid-ship portion of the vessel are advantageously at level such that the life boats will be supported directly adjacent a deck 68 so that access to the boats will be easy.

As shown in FIGS. 7, 8, and 10, 11, 12 and 13 it is possible to pivot the support elements so that by controlling of the angle between the members A and B, B and C, C and D, and D and E it is possible to launch the life boat either closely alongside the vessel or as shown in FIG. 8 for example, or removed from the side of the vessel as shown in FIGS. 10, 11 and 12. The arrangement is such that any desired lowering of the boat may be accomplished to position the life boat either directly adjacent the side of the vessel which may be sinking or at a spaced location outwardly from the vessel. In this way it is possible to launch over areas which may contain damaged portions of the vessel or burning wreckage in the sea. In addition it is possible to launch the life boat far away from the side of the vessel if necessary or even close to the side of the vessel in those cases where it is desirable.

Figure 2:
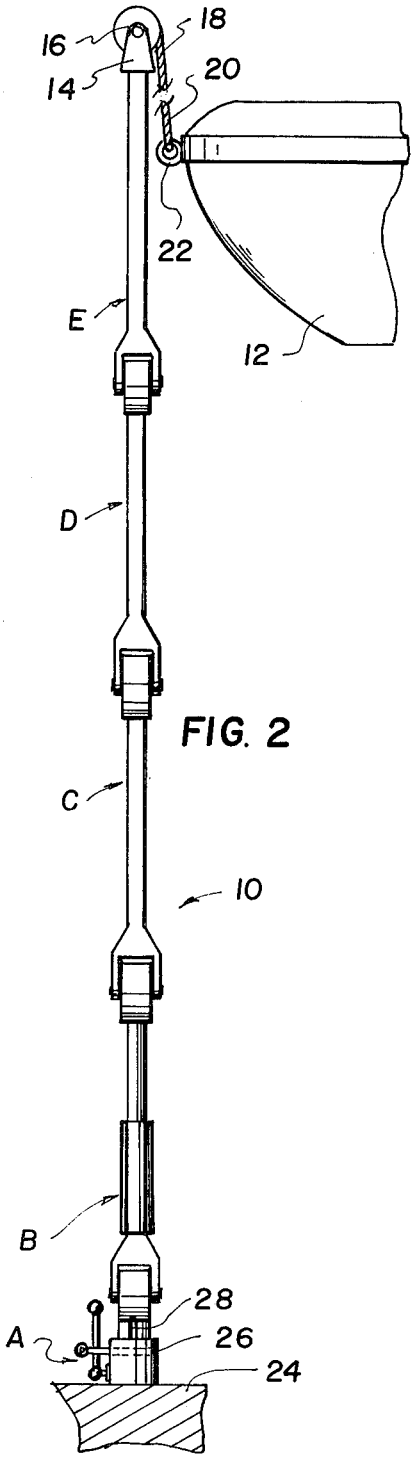
FIG. 2 is a partial side elevational view of the structure shown in FIG. 1.

In accordance with the method of the invention the lifeboat 12 is connected to the upper support member E which extends vertically upwardly from the other support members, as indicated in FIGS. 1 and 2, as well as above a lowermost support member A which is adapted to be secured on the vessel deck. With the method of the invention a force is provided by the weight of the superjacent support members and the lifeboat in the form of a fluid pressure force which is generated in a pressure chamber 34 shown in FIG. 5. This force is applied to pivot a selected one or ones of the support members A, B, C, D or E. This pivotal movement is carried out by applying the force against a vane 44 in the embodiment shown in FIG. 3 and may be used to either pivot one member E relative to the member D for example or to hold these two members so that they extend rigidly in respect to each other at a selected angle such as the vertical angle which is already set as shown in FIGS. 1 and 2. Thus the force may either effectively pivot the members relative to each other by deflecting the vane 44 and the associated support member which is connected thereto by a selected angle, or it may hold the vane 44 in a fixed position in its associated pressure chamber 32. With the method therefore the amount of lowering of the boat is controlled by the amount of pivoting of each member A, B, C, D and E relative to each other or by applying a restraint to such pivoting with a blocking of the pivotal connections. This is done in accordance with the method to achieve a displacement of the lifeboat such as is indicated in FIGS. 10, 11, 12 and 13.

In accordance with a method of the invention the lifeboat may be moved outwardly furthermost from the lowermost support member A as shown in the position to the left of FIG. 12 for example and by viewing FIGS. 1 and 2 by pivoting all of the elements B, C, D and E on the lowermost support member A while blocking the middle connections of C relative to B and D relative to C and E relative to D so that these extend horizontally outwardly from the uppermost end of the support A.

The programming for the members A, B, C, D and E and their pivoting movement may be effected by simple remote control station located on the life boat itself and preset or the presetting may be effected at the lowermost member, for example the member A by a suitable control panel which will both release each element so that it may pivot relative to the other or lock them together so that they do not pivot relative to each other and in addition the amount of such pivoting movement may be easily controlled. All of this may be accomplished by charts which would show the position of the life boat relative to the vessel and how to actuate the control so as to achieve the launching of the life boat to position it in respect to the vessel and in accordance with the charts indicated.

In the drawings the simple control member 64 shown as having a knob or handle 66 which may be shifted so as to vary the valve 38 and hence the pressurizing of the space 32 and thus the positioning of the vane member 44, all as shown in FIGS. 3 and 5 and 9. Of course it would be possible to use either electrical, hydraulic or direct mechanical elements 20 effect such control and shifting. It would appear that the most desirable case is to be able to launch each boat so as to position it as desired by merely mechanically actuating each of the members A, B, C, D and E so as to position the boat as desired in the water using only the force or the weight of the boat itself to affect the positioning and the changes of the linkage elements.

Various methods of manipulation of the individual supports A, B, C, D and E in the associated lifeboat 12 may be carried out to shift the boat through the angles necessary to launch it depending upon the condition of the associated vessel as shown for example in FIGS. 7 and 8 and 10 to 13. An important consideration of the method of the invention is that the control mechanism for regulating the pivotal movement of each of the support members A, B, C, D and E is provided which is powered by the weight of the individual elements themselves or by the lifeboat. With the inventive method this weight is used to generate a pressure force and this force is applied to pivot selected ones of the pivots and hold the others in rigid interconnection, such as is indicated on page 2 of the present specification in the first paragraph thereof.

While specific embodiments of the invention have been shown and described in detail to illustrate the application of the principles of the invention, it will be understood that the invention may be embodied otherwise without departing from such principles.

What is claimed is:

1. A support structure particularly for lifeboats, comprising a mounting support adapted to be connected to fixed support, a plurality of support members pivotally interconnected adjacent their associated ends and including a lowermost one pivotally connected to said mounting support, said support members being arranged in an upright position with one positioned above the other and the upper one of each adjacent pair being pivotal about a substantial horizontal axis downwardly in respect to the next adjacent lower one, and control means connected between adjacent members for controlling the pivotal rotation thereof in either selected direction for the amount of such pivotal rotation of each adjacent upper one in respect to the next adjacent lower one, said control means including a fluid pressure chamber, and a fluid drive connected between adjacent support members and connected to said fluid pressure chamber, the upper one of at least one of said arms and the weight of the lifeboat acting on said fluid pressure chamber to generate a fluid pressure to drive said fluid drive in either selected direction.

2. A support structure according to claim 1, wherein said fluid drive includes a vane movable in said pressure chamber, and a shaft connected to said vane and extending out of said pressure chamber.

3. A support structure particularly for lifeboats, comprising an upright mounting support member adapted to be connected to fixed support, a plurality of support members pivotally interconnected adjacent their associated ends and including a lowermost one pivotally connected to said mounting support member, said support members being arranged in an upright position with one positioned above the other and the upper one of each adjacent pair being pivotal about a substantially horizontal axis downwardly in respect to the next adjacent lower one, and control means connected between adjacent members for controlling the pivotal rotation thereof in either selected direction and the amount of such pivotal rotation of each adjacent upper one in respect to the next adjacent lower one so as to lower the lifeboat to either side of said fixed support, means for mounting the lowermost one of said members so that it is in a substantially upright position, at least the next adjacent support member above said lowermost member having a shaft portion pivotally mounted on said lowermost member, said control means including a fluid pressure source, a vane member attached to said shaft portion connected to said fluid pressure source, said fluid pressure source being effective to move said vane member and thus said next uppermost member to pivot it about said lowermost member by a controlled amount.

4. A support structure according to claim 3, wherein one of said adjacent support members includes a cylinder portion and the other comprising a piston movable in said cylinder portion, said cylinder portion providing a fluid pressure source produced by the weight of said piston portion in said cylinder portion, said control means including means for directing said fluid pressure source to at least one of said support members to pivot it relative to the other.

5. A support structure according to claim 4, wherein one of said support members includes a vane member, means defining a fluid pressure chamber in the next adjacent one of said support members from said vane member in which said vane member is movable, means directing fluid pressure from said fluid pressure source to said fluid pressure chamber for moving said vane member to pivot the associated support member.

6. A support structure according to claim 3, wherein said control means comprises a mechanical control connected between said support members to effect pivotal movement therebetween of a predetermined amount.

7. A support structure according to claim 6, including means for locking said support members together in an upright position, said locking means being releasable, and means for initially pivoting at least one of said support members relative to the next adjacent one in a predetermined rotational direction.

8. A support structure according to claim 3, wherein each of said support members are pivotal relative to the next adjacent one by an angle of at least 90°.

9. A support structure according to claim 3, wherein at least one of said support members includes first and second portions which are telescopic relative to each other.

10. A support structure according to claim 3, including a life boat connected to the upper one of said support members, said support members being pivotal to swing said life boat from a position supported at the upper one of said members to one side of a support vessel and to shift the boat outwardly from the vessel by a predetermined amount.

11. A weight operated support structure for devices, particularly for life boats, comprising a support member adapted to be mounted in a fixed upright position on a support surface such as a boat deck, at least one additional support member supported on said first member and being pivotally mounted on said first member to vary its angular position in respect to said first member, support means pivotally supporting said additional support member in respect to said support member for pivotal movement about a substantially horizontal axis in either direction on said support member, means defining a fluid pressure source between said support member and said additional support member including a fluid pressure chamber and means for supporting said additional support member in said pressure chamber so as to pressurize said chamber, and control means connected to said additional support member and said means defining a fluid pressure source for effecting pivotal movement of said additional support member relative to said support member both in a selected rotational direction and in an amount of rotation.

12. The weight operated support structure according to claim 11, including a mechanical connection between said support member and said additional support member for controlling the amount of relative rotational movement therebetween.

13. A weight operated support structure according to claim 12, including means for locking said support member in said additional support member in the selected rotational position.

14. A weight operated support structure according to claim 11, wherein said additional support member comprises a lower piston portion, said support member having a receiving cylinder in which said piston portion is movable, the weight of said additional support member piston portion providing a fluid pressure, said additional support member having a vane portion exposed to said fluid pressure and being displaceable to rotate said additional support member in a selected direction relative to said support member.

15. A weight operated support structure according to claim 14, said support member including a fluid pressure chamber, said additional support member having a vane member movable in said pressure chamber and means for selectively directing pressure from said cylinder to said additional pressure chamber for shifting said vane member and said additional support member by a selected amount.

16. A weight operated support structure according to claim 15, including valve means for controlling the rotational direction of said vane member.

* * * * *